US005364063A

United States Patent [19]

Nishimura et al.

[11] Patent Number: 5,364,063

[45] Date of Patent: Nov. 15, 1994

[54] ICE CUBE TRAY

[75] Inventors: Eichi Nishimura, Kohshoku; Shoichi Takeda, Togura; Tohru Fujiwara, Omi; Nobushige Kobayashi, Nagano, all of Japan

[73] Assignee: MK Seiko Co., Ltd., Nagano, Japan

[21] Appl. No.: 179,236

[22] Filed: Jan. 10, 1994

[30] Foreign Application Priority Data

Aug. 5, 1993 [JP] Japan ..... 5-214969

[51] Int. Cl.[5] ..... F25C 1/24

[52] U.S. Cl. ..... 249/52; 249/82; 249/119; 249/120; 249/126; 249/133; 249/141

[58] Field of Search ..... 249/52, 69, 81, 82, 249/119, 120, 126, 127, 128, 129, 130, 133, 141; D15/90

[56] References Cited

U.S. PATENT DOCUMENTS 2,011,289 8/1935 Klyce, Jr. ..... 249/52
2,063,100 12/1936 Johnsen ..... 249/52
2,377,436 6/1945 Mallard ..... 249/82
2,601,324 6/1952 Ribeiro ..... 249/81
4,739,963 4/1988 Parmacek et al. ..... 249/82

FOREIGN PATENT DOCUMENTS 63-185073 11/1988 Japan .
2-106674 4/1990 Japan ..... 249/69
4-26864 6/1992 Japan .

*Primary Examiner*—James Mackey
*Attorney, Agent, or Firm*—Harris, Wallen, MacDermott & Tinsley

[57] ABSTRACT

An ice cube tray consisting of an inner tray divided lengthwise and breadthwise into a plurality of pockets with open tops, and an outer tray divided into a configuration that fits the shape of the inner tray forming a space between the outer bottom of the inner tray and the inner bottom of the outer tray, with openings provided on the bottom of the inner tray so as to make transparent ice in the pockets, and additionally providing slightly curved protruding points on the bottom of the outer tray to allow for expansion.

3 Claims, 2 Drawing Sheets

ICE CUBE TRAY

BACKGROUND OF THE INVENTION

The present invention relates to ice cube trays used for household refrigerators and is especially related to the ones with a double structure of inner and outer trays enabling transparent ice to be made.

An example of a conventional ice cube tray of this known type is the one disclosed in Japanese Provisional Utility Model Publication No. 185073/1988, which consists of an inner tray divided lengthwise and breadthwise into plural numbers of cubic pockets with an open top, and of an outer tray divided into such configuration that fits the shape of said inner tray, with a space to be formed, when assembled, between the outer bottom of the inner tray and the inner bottom of the outer tray, with some openings provided on the bottom of the inner tray to adjoin the said space so as to make transparent ice in the said cubic pockets.

The water in an ice cube tray freezes first from the surface and then downward to the bottom. Since it starts freezing first from pure water, the end result is that opaque ice containing air and impurities such as chlorinated lime is intensively made in the bottom area of the ice cube tray. The ice cube tray of this kind is so designed as to make use of this phenomenon, i.e., getting only the transparent ice made in the inner tray by driving the opaque part away into the said space in the lower part of the ice cube tray.

Another example of an ice cube tray, as seen in Japanese Official Utility Model Publication No. 26864/1992, is the one with an upper space provided between the inner and the outer trays so as to absorb expansion of the freezing water. However, in this form of an ice cube tray, the said upper space is provided only around the whole body of the ice tray, so that the expansion caused in the central area of the ice cube pockets cannot be completely absorbed, thus making it difficult to get transparent ice in every ice cube pocket especially when the ice cube tray has a large number of ice cube pockets.

Another problem was that the thick ice layer formed between the inner and the outer trays makes both of the trays stick together tightly, thus making it difficult to release the ice cubes by twisting the tray, which can be easily done in the case of a general ice cube tray without a double structure.

SUMMARY OF THE INVENTION

It is an object of the invention to provide an improved ice cube tray that can always make transparent ice with little opaque portion in the inner tray, by enabling the said space provided between the outer bottom of the inner tray and inner bottom or the outer tray to expand.

It is another object of the invention to provide an improved ice cube tray that can easily release ice cubes by twisting the tray, as well as making transparent ice with little opaque portion in every cube pocket of the inner ice cube tray.

This invention is intended to accomplish the first object described above in regard to the ice cube tray consisting of an inner tray divided lengthwise and breadthwise into plural number of cubic pockets with an open top, and of an outer tray divided into such configuration that fits the shape of said inner tray, with a space to be formed, when assembled, between the outer bottom of the inner tray and the inner bottom of the outer tray, with some openings provided on the bottom of the inner tray to adjoin said space so as to make transparent ice in the said cubic pockets, by additionally providing slightly curved points on the bottom of the outer tray that forms the said space so as to allow the said space to expand.

Further, it is also intended to accomplish the second object described above in regard to ice cube tray consisting of an inner tray divided lengthwise and breadthwise into plural number of cubic pockets with an open top, and of an outer tray divided into such configuration that fits the shape of said inner tray, with a space to be formed, when assembled, between the outer bottom of the inner tray and the inner bottom of the outer tray, with some openings provided on the bottom of the inner tray to adjoin said space so as to make transparent ice in the said cubic pockets, by elevating the walls of the ice cube pockets of the said inner tray above the water surface of the said outer tray so as to form, when assembled together, a space in the upper part of the walls; while the said outer tray forms an appropriate space between the inside of its walls and the outside of the said inner tray walls as well as its lower part narrowed by denting so as to make the said space partially small.

By this measure, the space formed between the outer bottom of the inner tray and the inner boltore of the outer tray can expand through the slightly curved points provided on the bottom of the outer tray. The end result is that transparent ice with little opaque portion can be obtained without fail in the ice cube pockets due to the fact that, if the water containing impurities and air freezes and expands in the said space, where it was driven into, the curved points on the bottom can absorb the expansion so as not to allow the water flow back into the ice cube pockets area.

Also, by elevating the ice cube pocket walls of the inner tray above the water surface of the outer tray so as to form a space in the upper part of the walls, an appropriate space is also formed between the inside of the outer tray walls and the outside of the inner tray walls. Thus the space adjoining the space below is formed, between the inner and the outer trays, in the upper part of the ice cube pocket walls. The space formed at each ice cube pocket wall can absorb the expansion of the ice when it freezes in the space below, thus resulting in transparent ice being obtained in every ice cube pocket even when there are a large number of pockets.

Further, the lower part of the outer tray is narrowed by denting, so as to make the space formed around the ice cube pockets partially small. This dented part makes it easier to separate the ice layer made between the inner and the outer trays, i.e., by warping the whole body of the ice cube tray, the ice between the both trays can be separated vertically, so that the ice cubes can be easily released.

DESCRIPTION OF THE PREFERRED EMBODIMENT

The preferred embodiment of the ice cube tray according to the invention is explained as follows.

Figure 1:
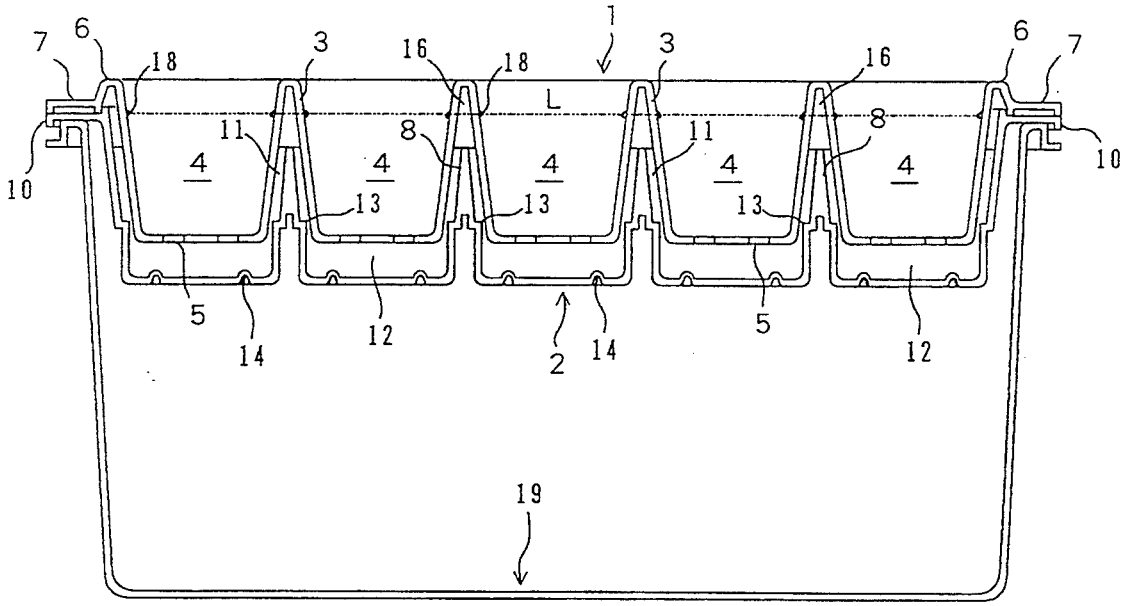
FIG. 1 is a cross sectional view of one embodiment of the ice cube tray of the invention.
Figure 2:
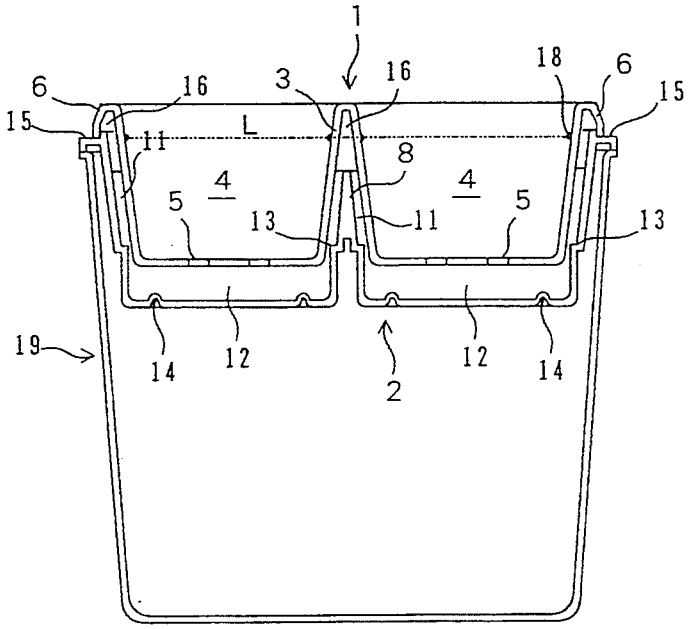
FIG. 2 is a vertical sectional view of the embodiment of FIG. 1.
Figure 3:
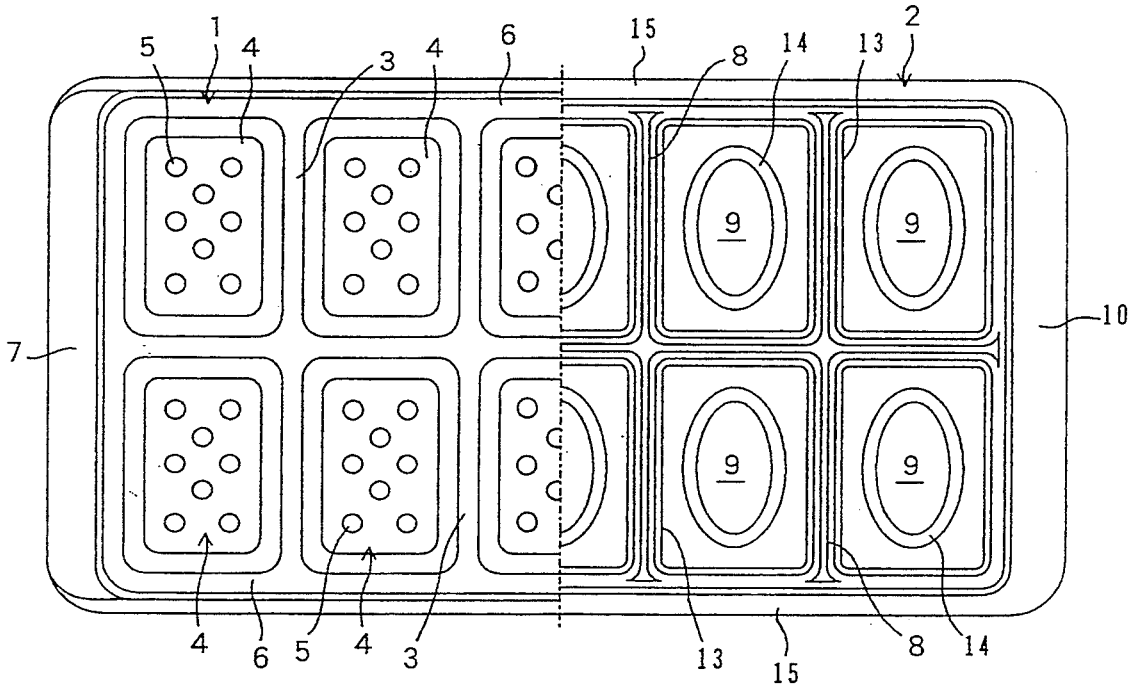
FIG. 3 is a top plan view with a portion showing the outer tray alone of the embodiment of FIG. 1 and FIG. 2.

FIG. 1, FIG. 2 and FIG. 3 show the cross section, the vertical section and the top plan of the embodiment of this invention. 1 shows the inner tray and 2 shows the outer tray, both of which are made of comparatively soft synthetic resin. The inner tray 1 is divided lengthwise and breadthwise by the plural number of walls 3 into a large number of ice cube pockets 4 with open tops pierced openings 5 are provided on the bottom of each ice cube pocket 4. Both of the longitudinal sides of the inner tray 1 are provided with the circumferential flanges 6 which are formed into the flanges 7 stretching out therefrom. The said walls 3 are so designed to project above the flanges 7.

The outer tray 2 is divided by the cubic pocket walls 8, in the same layout as the inner tray 1, to form the ice cube pockets 9 of the same number as the ice cube pockets 4. Also, just like the tray 1, both of the longitudinal sides are provided with the flanges 10 so as to fix and support the inner tray 1 when the flanges 7 lie on top of them when assembled together. When assembled with the inner tray 1, aperture 11 is formed between the outside of the wall 3 and the inside of the wall 8. Also, space 12 is formed between the bottom of the inner tray 1 and the outer tray 2.

Figure 4:
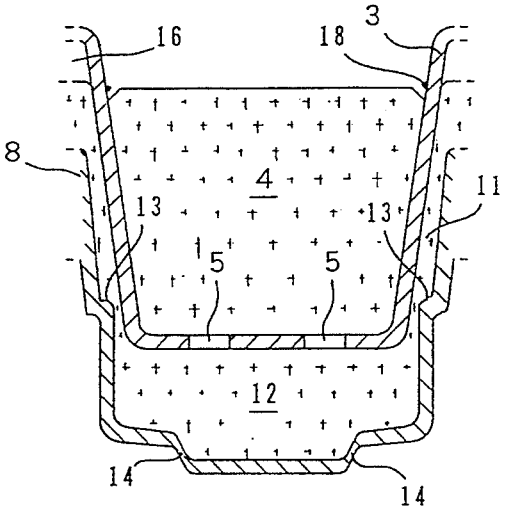
FIG. 4 is a partially sectional view showing the condition of the embodiment of FIG. 1, FIG. 2 and FIG. 3 when ice is made.

Toward the bottom of wall 8, the protuberance 13 is formed by protuding the wall toward the inside, thus making the lower part of the aperture 11 narrower and smaller. This protuberance 13 could be made so that a part of it contacts the outside of tile inner tray 1. Further, slightly curved points 14 are provided on the bottom of the outer tray 2. As shown in FIG. 4, when the volume of the water that freezes in the ice cube pocket 4 and the space 12 swells and expands, the curved points 14 stretch out to absorb this expansion.

As to the inner tray 1, the walls 3 extended above the circumferential flanges 15, i.e., higher than the maximum water level surface of the outer tray 2, by which space 16 is formed in the upper part between the walls 3, and the space 16 is adjoined to the space 12 through the aperture 11. Also, the walls 8 are so designed to be lower than the said water level L, so that, when the water is supplied nearly as high as this water level L, the water will flow over the walls 8, thus keeping the water level of each ice cube pocket 4 even. 18 is the graduation for the water to be supplied into the inner tray 1 in accordance with the water level L.

19 is the case to fit and support the outer tray 2, which can be used to store the ice cubes made in the inner tray 1. This case 19 also supports the outer tray 2 by closely contacting its circumferential flanges 15, as well as forming an insulation space below the outer tray 2. In other words, if the outer tray 2 is put directly into the freezer, the water in the ice cube tray is cooled from the bottom of the outer tray 2, thus hindering the water from freezing in its right order, from its surface toward the bottom. In order to prevent this, the insulation space is provided between the bottom of the outer tray 2 and the direct surface of the freezer.

The following is the explanation for the practical use of the said ice tray. When the inner tray 1 anti the outer tray 2 are put together, water such as tap water is poured into them. The water is first supplied into the ice cube pockets 4 of the inner tray 1 and then, through the openings 5, into the outer tray and over the walls 8, so as to fill the other ice cube pockets one after another. In this way, water is supplied to the level that will not exceed the graduation 18. The tray is then inserted into the case 19 to be put into a freezer of a household refrigerator.

In a refrigerator, water starts freezing from the water surface of the inner tray 1. Moreover, pure water freezes first, i.e., impurities and air are gradually gathered toward the bottom to be driven away into the space 12 below. As the result, transparent ice with little impurities can be made in the ice pockets 4.

When the water containing impurities and air starts freezing in the space 12, the air melted into the water will be separated to cause an expansion of its cubic volume. At this point, the water in the aperture 11, being isolated from the cold air in the freezer, is either not frozen or in its first stage of freezing, i.e., this expansion can be absorbed into the space 16. When the water keeps on :freezing further, the water in the aperture 11 will freeze, thus making it difficult for the space 16 to absorb the expansion. This time, however, the curved points 14 will stretch to make the bottom of the outer tray 2 expand outwardly, thus keeping the opaque portion from flowing back again into the ice cube pockets 4.

When the water completes freezing, the ice cube tray should be taken out from the refrigerator. By holding and twisting the flanges 7 and 10, the transparent ice in the ice cube pockets 4 can be easily released. That is, when the ice cube tray is twisted, not only the transparent ice in the ice cube pockets 4 is separated from the opaque ice in the space 12 but also the ice in the space 12 and the aperture 11 is separated by the protuberance 13, thus easily pulling the inner tray 1 and the outer tray 2 apart. Therefore, as soon as the transparent ice in the cube pockets 4 is released and the opaque ice part left in the outside of the inner tray 1 and in the outer tray 2 is washed off with running water, the ice cube tray is ready for the next use.

What is claimed is:

1. An ice cube tray comprising in combination an inner tray divided lengthwise and breadthwise into a plurality of pockets with an open top and an outer bottom, and an outer tray having an inner bottom, and divided into a configuration that substantially corresponds to the shape of said inner tray, wherein the inner tray is seated within the outer tray thereby forming a space between the outer bottom of the inner tray and the inner bottom of the outer tray, with means defining openings in the outer bottom of the inner tray to adjoin said space so as to make transparent ice in the said pockets, and means defining curved expansion protruding points on the inner bottom of the outer tray so as to allow the said space to expand.

2. An ice cube tray as defined in claim 1 further comprising a case with an open top underneath the said outer tray to receive and store ice cubes.

3. An ice cube tray comprising in combination an inner tray divided lengthwise and breadthwise into a plurality of pockets with side walls, an open top, and an outer bottom, and an outer tray having side walls and an inner bottom, and divided into configuration that substantially corresponds to the shape of said inner tray, wherein the inner tray is seated within the outer tray thereby forming a first space between the outer bottom of the inner tray and the inner bottom of the outer tray, and an uppermost part of said outer tray defining a water level surface, with means defining openings in the outer bottom of the inner tray to adjoin said first space has been added after "the outer tray," and with the said side walls of the said inner tray extending above the uppermost part of the said outer tray forming a second space between upper parts of the said side walls of the said inner and outer trays, and with inwardly projecting shoulders in the said side walls of the said outer tray defining a lower narrowed portion of said second space.

* * * * *